US006725818B2

(12) United States Patent
Methley

(10) Patent No.: US 6,725,818 B2
(45) Date of Patent: Apr. 27, 2004

(54) VARIABLE CAMSHAFT ASSEMBLY

(75) Inventor: Ian Methley, Witney (GB)

(73) Assignee: Mechadyne PLC, Oxon (GB)

( * ) Notice: Subject to any disclaimer, the term of this patent is extended or adjusted under 35 U.S.C. 154(b) by 0 days.

(21) Appl. No.: 10/150,589

(22) Filed: May 16, 2002

(65) Prior Publication Data

US 2002/0170514 A1 Nov. 21, 2002

(30) Foreign Application Priority Data

May 18, 2001 (GB) ..... 0111803

(51) Int. Cl.[7] ..... F01L 1/02

(52) U.S. Cl. ..... 123/90.27; 123/90.16; 123/90.6; 29/888.1

(58) Field of Search ..... 123/90.15, 90.17, 123/90.31, 90.6, 90.27; 74/567; 29/888.1, 428, 453, 507, 505, 523, 522.1

(56) References Cited

U.S. PATENT DOCUMENTS 3,897,760 A * 8/1975 Hisserich ..... 123/90.16
5,101,554 A * 4/1992 Breuer et al. ..... 29/888.1
5,235,939 A * 8/1993 Levin et al. ..... 123/90.15
5,259,268 A * 11/1993 Ebbinghaus et al. ..... 74/567
5,273,710 A * 12/1993 Zengin ..... 419/47
5,299,881 A * 4/1994 Mettler-Friedli ..... 403/274
5,494,009 A * 2/1996 Yamada et al. ..... 123/90.17
5,664,463 A * 9/1997 Amborn et al. ..... 74/567
5,724,860 A * 3/1998 Sekiguchi et al. ..... 74/567
5,937,812 A * 8/1999 Reedy et al. ..... 123/90.34
6,182,362 B1 * 2/2001 Lancefield ..... 29/888.1

OTHER PUBLICATIONS

Osamu Hirano, Production of Assembled Camshaft, Japanese Patent Application No. 60–009803, Jan. 18, 1985.*

* cited by examiner

*Primary Examiner*—Thomas Denion
*Assistant Examiner*—Ching Chang
(74) *Attorney, Agent, or Firm*—Smith-Hill and Bedell

(57) ABSTRACT

A variable camshaft assembly has a first cams 18*a*, 18*b* that can be moved relative to a second cam 16. The assembly comprising a tube 14 fast in rotation with the first cam 18 and rotatably supporting the second cam 16 and a drive shaft 12 disposed within the tube 14 and coupled for rotation with the second cam 16 by means of a connecting pin 20 that passes with clearance through a hole 24 in the tube 14. The connecting pin is a hollow pin 20 that is a sliding fit in the second cam 16 and that is expanded in situ to form an interference with the drive shaft 12.

11 Claims, 3 Drawing Sheets

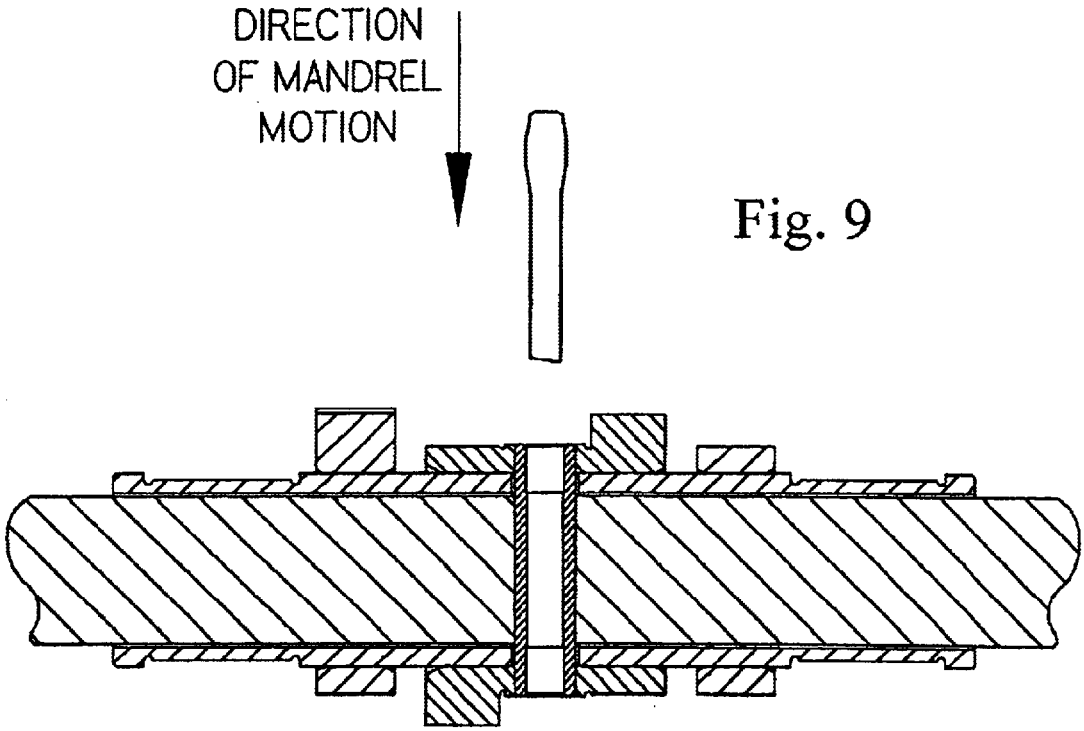
Fig. 9
Fig. 10
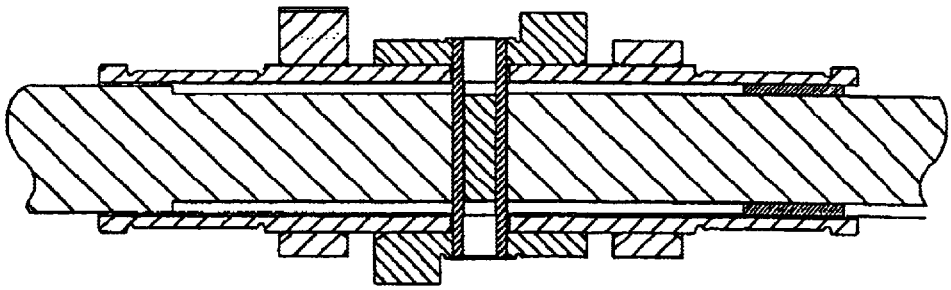

VARIABLE CAMSHAFT ASSEMBLY

FIELD OF THE INVENTION

This invention relates to a variable camshaft assembly in which one set of cam lobes can be moved relative to a second set of cam lobes.

BACKGROUND OF THE INVENTION

Camshaft assemblies are known which comprise a tube to which some of the cam lobes are fixed and about which other cam lobes are free to rotate. A drive shaft that passes through the bore of the tube and connecting pins that pass with clearance through an aperture in the tube couple the rotatable cam lobes to the drive shaft. The angle of the individual cam lobes can thus be controlled by setting the angle of the drive shaft relative to the drive tube.

In order to minimise any angular variation between the cam lobes attached to the drive shaft, it is advantageous to retain the connecting pins in the shaft via an interference fit, whilst the connecting pins have a small clearance in the cam lobes. If the clearance fit were to be located at the interface between the pins and the drive shaft, a more significant angular variation would result.

It should be noted that the connecting pins cannot be an interference fit in both the drive shaft and the cam lobe as small tolerance variations would result in the assembly becoming locked. The cam lobe axis of rotation is defined by the sliding fit on the outer surface of the tube and the drive shaft is required only to give angular alignment of the cam lobe. If there were to be no clearance in the system, the drive shaft would also attempt to determine the cam lobe axis of rotation and hence small tolerance variations would prevent the assembly from rotating freely.

In order to allow the assembly of the connecting pins into the drive shaft, it is necessary to ensure that the axial force applied to the pin to overcome the interference fit in the drive shaft cannot cause the shaft to bend beyond its elastic limit. This has been achieved in the past by providing bearing areas on the drive shaft that are a running fit in the bore of the tube adjacent to each of the connecting pins. The assembly can then be supported on the cam lobe or the tube whilst the connecting pins are pressed into position without the drive shaft becoming distorted.

Whilst this design has been demonstrated to be a successful method of producing a camshaft assembly of this type, it does have two disadvantages, namely:

- The whole bore of the tube must be accurately positioned to its outer diameter and finished to an accurate diametral tolerance.
- A number of bearing areas need to be finished on the shaft to an accurate tolerance and these are subsequently redundant once the components have been assembled since only two bearings are necessary to position the shaft in the bore of the tube.

These two factors can have a significant effect upon the ease of manufacture and hence the cost of the assembly and the aim of the invention is to mitigate these problems.

SUMMARY OF THE INVENTION

In accordance with a first aspect of the invention, there is provided a method of assembling a variable camshaft assembly having a first cam lobe that can be moved relative to a second cam lobe, the assembly comprising a tube to which the first cam lobe is fixed and about which the second cam lobe is free to rotate, a drive shaft that passes through the bore of the tube and a connecting pin that passes with clearance through an aperture in the tube to couple the second cam lobe for rotation with the drive shaft, which method comprises inserting into holes in the cam lobe and in the drive shaft a hollow connecting pin having a constant outer diameter dimensioned to be a close fit in the holes, and expanding the outer diameter of the connecting pin only within the region of the pin that lies within the drive shaft so that an interference fit is generated with the drive shaft.

Preferably, the connecting pin has an inner diameter that varies along its length, being larger at its end engaging the cam lobe than at its region in line with the drive shaft, and the outer diameter of the pin is expanded by inserting into the pin an element of larger outer diameter than the smaller inner diameter region of the connecting pin.

The element used to expand the pin may be a pin, a ball or a screw that remains within the pin after assembly is completed. Alternatively, it may be a mandrel that is withdrawn from the pin after it has locally stretched the pin beyond its elastic limit.

In accordance with a second aspect of the invention, there is provided a variable camshaft assembly having a first cam that can be moved relative to a second cam, the assembly comprising a tube fast in rotation with the first cam and rotatably supporting the second cam and a drive shaft disposed within the tube and coupled for rotation with the second cam by means of a connecting pin that passes with clearance through a hole in the tube, wherein the connecting pin is a hollow pin that is a sliding fit in the second cam and that is expanded in situ to form an interference with the drive shaft.

Because the pin can be expanded into an interference fit with the drive shaft without applying an excessive force tending to bend the drive shaft, it is no longer necessary for the drive shaft to be supported along its entire length and it can instead, in accordance with a preferred feature of the invention, be journalled in the surrounding outer tube at only two locations, preferably its axial ends, leaving a clearance between the drive shaft and the tube over the major proportion of its length. Such a clearance obviates the need for the entire bore of the tube and the outer surface of the drive shaft to be accurately machined.

The bearings may each take the form of an inserted bush, or the drive shaft could run directly against a machined surface inside the tube.

BRIEF DESCRIPTION OF THE DRAWINGS

The invention will now be described further, by way of example, with reference to the accompanying drawings, in which:

FIG. 9 is a section similar to that of FIG. 2 illustrating a fourth embodiment of the invention, and FIG. 10 is a section similar to that of FIG. 2 showing two further possible variants.

DETAILED DESCRIPTION OF THE PREFERRED EMBODIMENTS

Figure 1:
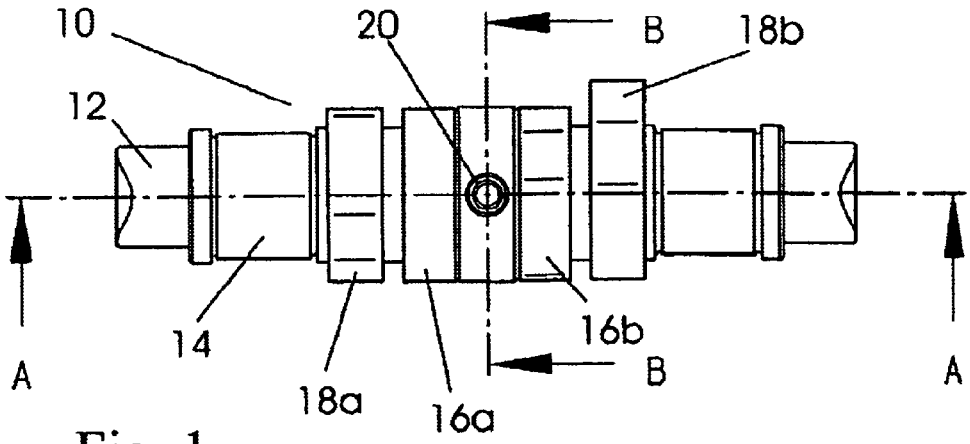
FIG. 1 is a side view of a camshaft of a first embodiment of the invention.
Figure 2:
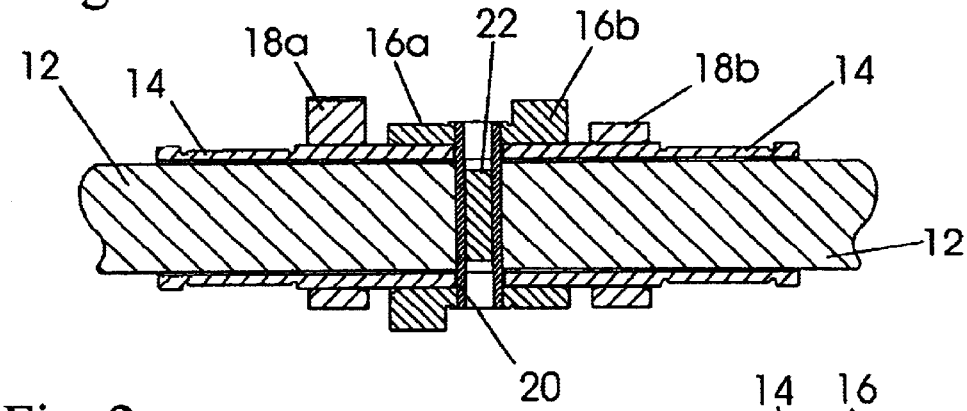
FIG. 2 is a section along the section line A—A in FIG. 1.
Figure 4:
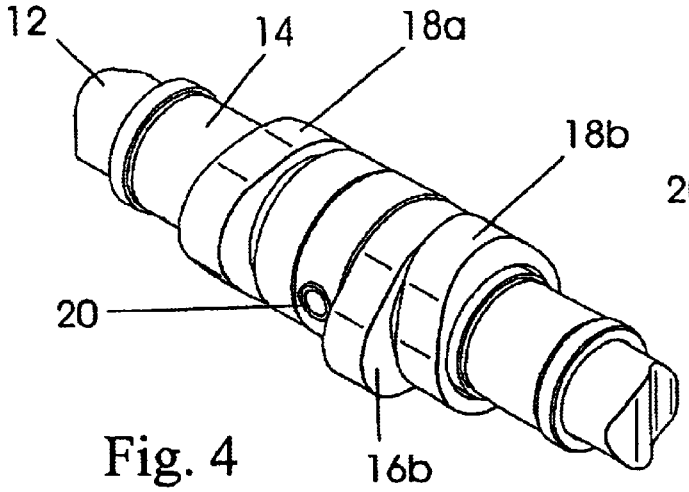
FIG. 4 is a perspective view of the camshaft of FIG. 1 in its assembled state.
Figure 3:
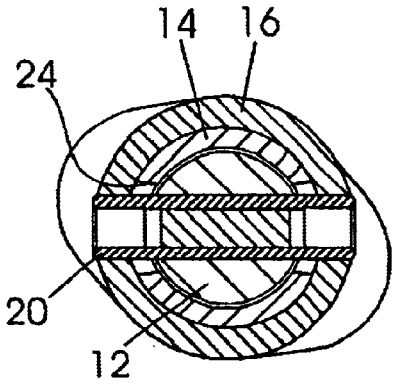
FIG. 3 is a section along the section line B—B in FIG. 1.
Figure 5:
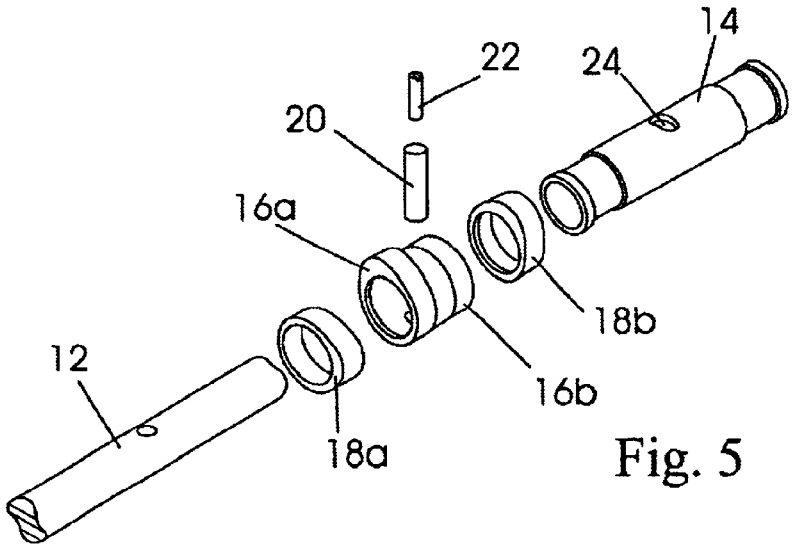
FIG. 5 is an exploded perspective view of the camshaft shown in FIGS. 1 to 4.

In all the figures, a camshaft 10 is shown that comprises an inner drive shaft 12 journalled within an outer tube 14. Cams 18*a* and 18*b* are directly mounted on the tube 14 for rotation therewith and further cams 16*a* and 16*b* are freely rotatable about the tube 14 and are connected for rotation with the drive shaft 12 by means of a hollow pin 20 that passes with clearance through a hole 24 in the outer tube 14. This construction is common to all the described embodiments which only differ from one another in the manner in which the pin 20 is made to engage in the drive shaft 12.

In the first embodiment shown in FIGS. 1 to 5, the bore of the connecting pin 20 is formed with two different diameters, the central portion having a diameter that is smaller than that of the two ends. A cylindrical element 22 is inserted into the pin 20 after it has been inserted into the drive shaft 12. The element 22 is an interference fit in the central portion of the connecting pin 20 and its insertion causes the outer diameter of the pin 20 to expand also, thus retaining the pin 20 in the drive shaft 12. If the cylindrical element were to be removed, the pin would return to its original size and could be removed simply.

Figure 6:
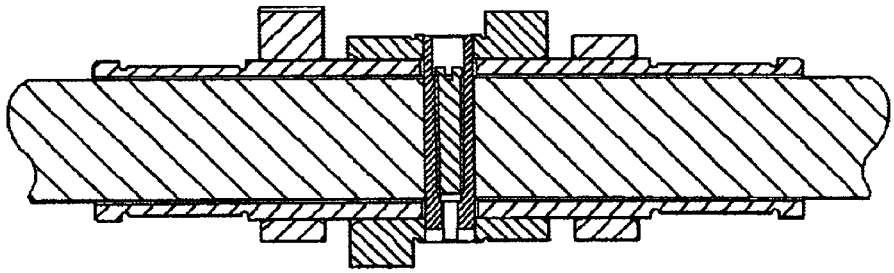
FIG. 6 is a section similar to that of FIG. 2 showing a second embodiment of the invention.
Figure 7:
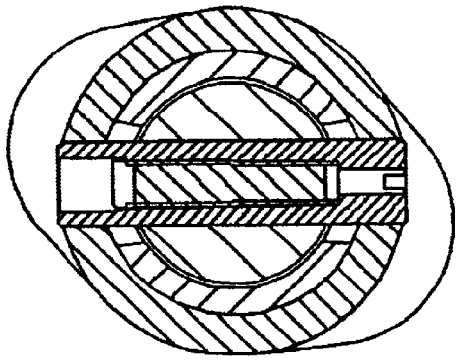
FIG. 7 is a section similar to that of FIG. 3 showing the second embodiment of the invention.

In the case of the second embodiment, shown in FIGS. 6 and 7, a tapered thread or an interference fit thread is provided on an element 122 that can be screwed into the bore of the connecting pin to fix the pin in position in the drive shaft. A slot or similar feature is required in one end of the connecting pin 20 to prevent the pin from rotating as the threaded element 122 is screwed into position.

Figure 8:
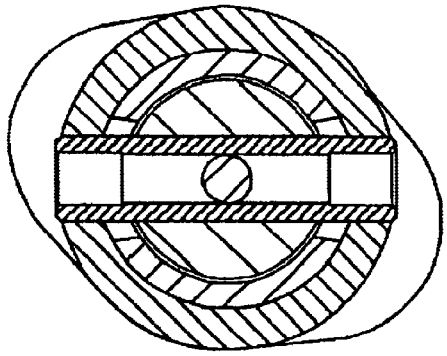
FIG. 8 is a section similar to that of FIG. 3 showing a third embodiment of the invention.

The third embodiment of FIG. 8, is similar in concept to the first embodiment, but one or more spherical elements 222 are pushed into the bore of the connecting pin 20 in order to expand it into the bore in the drive shaft 12.

A fourth embodiment of the invention., shown in FIG. 9, avoids the need to insert an additional component into the bore of the connecting pin 20. Instead, the connecting pin has a mandrel 322 forced through it which is sized such that the central portion of the connecting pin 20 is expanded considerably beyond its elastic limit, and therefore remains an interference fit in the drive shaft 12, even when the mandrel 322 has been removed.

In all the embodiments of the invention, the force applied to the connecting pin by the insertion of the locking elements or mandrel can be resisted on the end of the connecting pin itself and there will be no tendency to bend the drive shaft. For this reason, it suffices to support the drive shaft 12 within the outer tube at only two axially spaced bearing locations, which may be formed either by suitably machined surfaces (as shown on the left hand side of FIG. 10) or an inserted bush (as shown on the right hand side of FIG. 10). The need to machine the inner diameter of tube 14 and the outer diameter of the drive shaft 12 accurately over their entire length is thus obviated.

What is claimed is:

1. A method of assembling a variable camshaft assembly having a first cam lobe that can be moved relative to a second cam lobe, the assembly comprising a tube to which the first cam lobe is fixed and about which the second cam lobe is free to rotate, a drive shaft that passes through the bore of the tube and a connecting pin that passes with clearance through an aperture in the tube to couple the second cam lobe for rotation with the drive shaft, which method comprises inserting into holes in the second cam lobe and in the drive shaft a hollow connecting pin having a constant outer diameter dimensioned to be a close fit in the holes, and expanding the outer diameter of the connecting pin only within the region of the pin that lies within the drive shaft so that an interference fit is generated with the drive shaft, wherein the connecting pin has an inner diameter that varies along its length, being larger at its end engaging the cam lobe than at its region in line with the drive shaft, and the outer diameter of the pin is expanded by inserting into the pin an element of larger outer diameter than the smaller inner diameter region of the connecting pin.

2. A method as claimed in claim 1, wherein the inserted element is cylindrical.

3. A method as claimed in claim 1, wherein the inserted element is spherical.

4. A method as claimed in claim 1, wherein the inserted element is a screw.

5. A method as claimed in claim 1, wherein the inserted element is a mandrel that is withdrawn from the pin after it has locally stretched the pin beyond its elastic limit.

6. A variable camshaft assembly having a first cam that can be moved relative to a second cam, the assembly comprising a tube fast in rotation with the first cam and rotatably supporting the second cam and a drive shaft disposed within the tube and coupled for rotation with the second cam by means of a connecting pin that passes with clearance through a hole in the tube, wherein the connecting pin is a hollow pin that is a sliding fit in the second cam and has an inner diameter that varies along its length, being larger at its end engaging the second cam than at a smaller inner diameter region in line with the drive shaft, whereby, during assembly of the camshaft, insertion into the hollow pin of an element of larger outer diameter than the smaller inner diameter region of the connecting pin acts to expand the outer diameter of the pin in situ to form an interference fit with the drive shaft.

7. A variable camshaft as claimed in claim 6, wherein the drive shaft is rotatably supported within the tube at only two bearing locations and is spaced from the tube along the remainder of its length.

8. A variable camshaft as claimed in claim 7, wherein the bearing locations include bushes arranged between the drive shaft and the surrounding tube.

9. A variable camshaft as claimed in claim 7, wherein the drive shaft and the surrounding tube are machined to make direct contact with one another at the bearing locations.

10. A variable camshaft assembly comprising:

a tube, a first cam mounted on the tube for rotation therewith, a second cam rotatably supported by the tube, whereby the first and second cams are movable relative to each other, a drive shaft disposed within the tube, and a connecting pin that passes with clearance through a hole in the tube and couples the tube for rotation with the second cam, wherein the connecting pin is a hollow pin that is a sliding Lit in the second cam and has an inner diameter that varies along its length, being larger at its end engaging the second cam than at a smaller inner diameter region in line with the drive shaft, whereby, during assembly of the camshaft, insertion into the hollow pin of an element of larger outer diameter than the smaller inner diameter region of the connecting pin acts to expand the outer diameter of the pin in situ to form an interference fit with the drive shaft.

11. A variable camshaft assembly having a first cam that can be moved relative to a second cam, the assembly comprising a tube fast in rotation with the first cam and rotatably supporting the second cam and a drive shaft disposed within the tube and coupled for rotation with the second cam by means of a connecting pin that passes with clearance through a hole in the tube, wherein the connecting pin is a hollow pin that is a sliding fit in the second cam and that is expanded in situ to form an interference fit with the drive shaft the drive shaft is rotatably supported within the tube at only two bearing locations and is spaced from the tube along the remainder of its length, and the drive shaft and the surrounding tube are machined to make direct contact with one another at the bearing locations.

* * * * *